US007186125B2

(12) United States Patent
Watanabe et al.

(10) Patent No.: US 7,186,125 B2
(45) Date of Patent: Mar. 6, 2007

(54) CONDUCTIVE PATH AND CONNECTOR

(75) Inventors: Kunihiko Watanabe, Mie (JP); Toshiaki Suzuki, Mie (JP); Kazumoto Konda, Mie (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/168,850

(22) Filed: Jun. 29, 2005

(65) Prior Publication Data

US 2006/0003610 A1 Jan. 5, 2006

(30) Foreign Application Priority Data

Jun. 30, 2004 (JP) ..... 2004-193892

(51) Int. Cl.
*H01R 4/60* (2006.01)

(52) U.S. Cl. ..... 439/213

(58) Field of Classification Search ..... 439/213, 439/877, 949; 174/84 C, 71 B, 888; 29/522.1
See application file for complete search history.

(56) References Cited

U.S. PATENT DOCUMENTS 5,051,020 A * 9/1991 Schleicher ..... 403/282
5,530,625 A * 6/1996 VanDerStuyf et al. ..... 361/794
5,865,638 A * 2/1999 Trafton ..... 439/288

FOREIGN PATENT DOCUMENTS

JP A 11-297373 10/1999

* cited by examiner

*Primary Examiner*—Phuong Dinh
(74) *Attorney, Agent, or Firm*—Oliff & Berridge, PLC

(57) ABSTRACT

A conductive path includes a terminal metal piece; and a bus bar overlapped with the terminal metal piece. The terminal piece and the bus bar are bonded while the terminal piece and the bus bar are deformed to form a recess portion on a surface where the terminal metal piece is overlapped with the bus bar by pressing the terminal metal piece and the bus bar with a die in a direction of intersecting with an overlapped face between the terminal metal piece and the bus bar.

8 Claims, 6 Drawing Sheets

CONDUCTIVE PATH AND CONNECTOR

BACKGROUND OF THE INVENTION

1. Field of the Invention

The present invention relates to a conductive path and a connecter.

2. Description of the Related Arts

In a background art, JP-A-11-297373 discloses a conductive path of a mode of coupling metal plate members in which a bus bar and a terminal metal piece are fixed by using a rivet.

SUMMARY OF THE INVENTION

According to the conductive path configured by fixing the bus bar and the terminal piece by using the rivet as in the background art, a surface of the terminal metal piece and a surface of the bus bar are simply brought into contact with each other. Therefore, for example, when the terminal metal piece is bonded to a face on a projected side of the bus bar bent to deform by pressing, a bonding face thereof does not constitute face contact, contact resistance between the terminal metal piece and the bus bar becomes unstable and there is a concern of deteriorating contact reliability.

It is an object of the invention to promote contact reliability in the conductive path and the connector using the same.

According to one aspect of the invention, there is provided with a conductive path includes a terminal metal piece; and a bus bar overlapped with the terminal metal piece. The terminal piece and the bus bar are bonded while the terminal piece and the bus bar are deformed to form a recess portion on a surface side by pressing the terminal metal piece and the bus bar with a die in a direction of intersecting with an overlapped face between the terminal metal piece and the bus bar.

When the terminal metal piece and the bus bar which are overlapped are deformed to form the recess portion by being pressed by the die, in the pressed bonding region, a surface of the terminal metal piece and a surface of the bus bar are metallurgically bonded while being deformed and therefore, in comparison with a constitution of simply bringing the surfaces of the terminal metal piece and the bus bar into contact with each other, bonding reliability is high.

According to another aspect of the invention, the terminal metal piece and the bus bar are bonded by being pressed with the die in a state of setting the terminal metal piece and the bus bar to a jig. The jig include a restricting portion restricting the terminal metal piece and the bus bar from being deformed to enlarge a projected shape when viewed in a direction of pressing the terminal metal piece and the bus bar by the die.

When the terminal metal piece and the bus bar are set to the jig and pressed by the die, the terminal metal piece and the bus bar are not deformed to enlarge the projected shape viewed in the die pressing direction and therefore, a shape and a size of the conductive path after bonding are not varied.

According to another aspect of the invention, the terminal metal piece and the bus bar are bonded by being pressed with the die in a state of setting the terminal metal piece and the bus bar to a jig. The jig has a restricting portion restricting the terminal metal piece and the bus bar from being deformed to warp back to a side opposed to a direction of pressing the terminal metal piece and the bus bar by the die at a surrounding of the recess portion.

When the terminal metal piece and the bus bar are set to the jig and pressed by the die, the terminal metal piece and the bus bar are not deformed to warp back to a side of being opposed to the direction of pressing the die at a surrounding of the recess portion and therefore, a shape thereof becomes stabilized.

According to another aspect of the invention, there is provided with a connector includes a conductive path formed by overlapping and bonding a terminal metal piece and a bus bar; and a housing capable of accommodating the conductive path. The terminal piece and the bus bar are bonded while the terminal piece and the bus bar are deformed to form a recess portion on a surface side by pressing the terminal metal piece and the bus bar with a die in a direction of intersecting with an overlapped face between the terminal metal piece and the bus bar.

When the terminal metal piece and the bus bar which are overlapped are deformed to form the recess portion by being pressed by the die, in the pressed bonding region, a surface of the terminal metal piece and a surface of the bus bar are metallurgically bonded while being deformed and therefore, in comparison with a constitution of simply bringing the surfaces of the terminal metal piece and the bus bar into contact with each other, bonding reliability is high.

According to another aspect of the invention, the terminal metal piece and the bus bar are bonded by being pressed with the die in a state of setting the terminal metal piece and the bus bar to a jig. The jig include a restricting portion restricting the terminal metal piece and the bus bar from being deformed to enlarge a projected shape when viewed in a direction of pressing the terminal metal piece and the bus bar by the die.

When the terminal metal piece and the bus bar are set to the jig and pressed by the die, the terminal metal piece and the bus bar are not deformed to enlarge the projected shape viewed in the die pressing direction and therefore, a shape and a size of the conductive path after bonding are not varied. Therefore, the conductive path can be held to the housing without play.

According to another aspect of the invention, the terminal metal piece and the bus bar are bonded by being pressed with the die in a state of setting the terminal metal piece and the bus bar to a jig. The jig has a restricting portion restricting the terminal metal piece and the bus bar from being deformed to warp back to a side opposed to a direction of pressing the terminal metal piece and the bus bar by the die at a surrounding of the recess portion.

When the terminal metal piece and the bus bar are set to the jig and pressed by the die, the terminal metal piece and the bus bar are not deformed to warp back to the side of being opposed to the pressing direction of the die at the surrounding of the recess portion and therefore, the shape and the size of the conductive path after bonding are not varied. Therefore, the conductive path can be held by the housing without play.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

<Embodiment 1>

Figure 1:
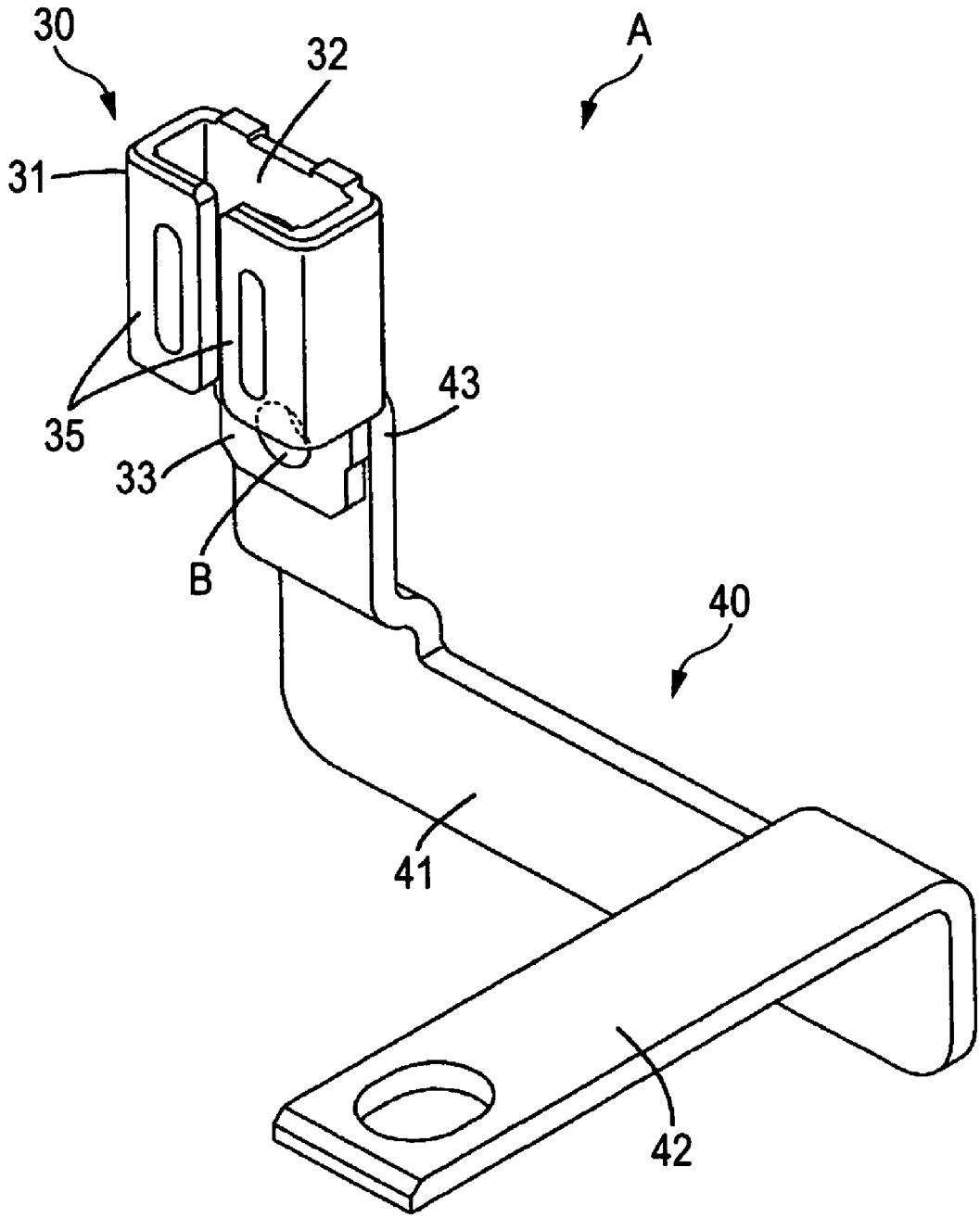
FIG. 1 is a perspective view of a conductive path.
Figure 2:
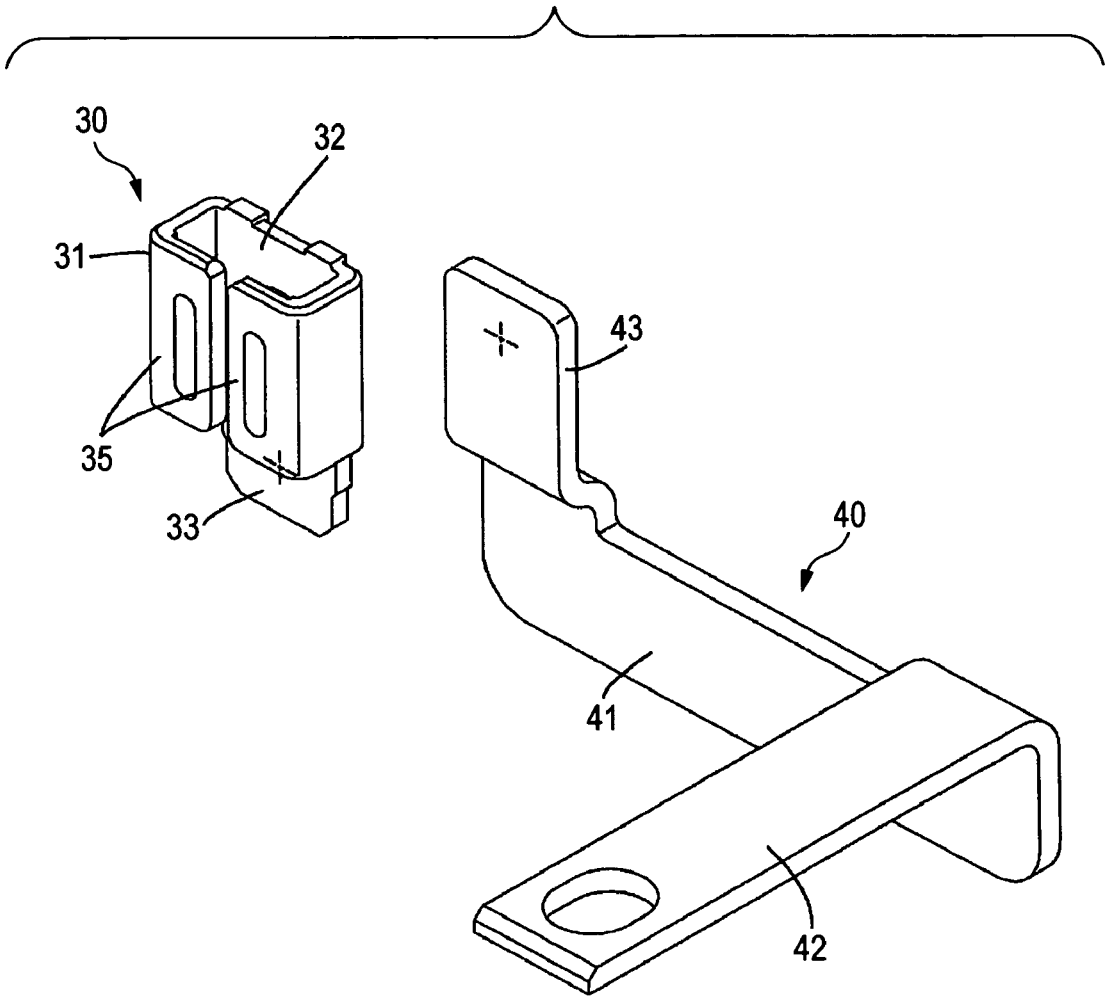
FIG. 2 is a perspective view of a state of separating a terminal metal piece and a bus bar.

Embodiment 1 embodying the invention will be explained in reference to FIG. 1 through FIG. 6 as follows. A female side connector F is configured by containing a conductive path A configured by bonding a terminal metal piece 30 and a bus bar 40 by cold pressure welding in a housing 10. The housing 10 is configured by a housing main body 11 made of a synthetic resin, a terminal holding member 12 comprising a synthetic resin integrated into the housing main body 11, and a plurality of bus bar holding members 13 comprising a synthetic resin integrated into the housing main body 11. Inside of the terminal holding member 12 is formed with a cavity 12*a* for containing the terminal metal piece 30 of the conductive path A without play. The plurality of bus bar holding members 13 constitute cavities 13*a* for holding the bus bar 40 without play.

The housing 10 of the female side connector F is formed with a fitting recess portion 14 opened upward, and a male side connector M is fitted to the fitting recess portion 14. The male side connector M is configured by containing a male terminal metal piece 22 at a cavity 21 formed in a housing 20 and the housing 20 is formed with a hood portion 23 surrounding a tab 22*a* directed downward at a front end of the male terminal metal piece 22. When the hood portion 23 is fitted into the fitting recess portion 14, the tab 22 advances into the terminal holding portion 12 to be connected to the terminal metal piece 30 of the conductive path A.

Next, the conductive path A will be explained.

The terminal metal piece 30 is configured by bending a plate member made of a copper alloy punched into a predetermined shape and is formed with a connecting portion 31 in a box-like shape at an upper end portion thereof. A lower end side of the terminal metal piece 30 constitutes a bonding portion 33 having substantially a rectangular flat plate shape continuous to be flush with a board 32 of the connecting portion 31. The board 32 of the connecting portion 31 is formed with a contact portion 34 having a projected shape capable of being brought into contact with the tab 22*a* by punching, and the tab 22*a* is connected to the terminal metal piece 30 in a state of being elastically pinched between the contact portion 34 and a receive plate 35 having the connecting portion 31.

The bus bar 40 is configured by bending a plate member made of copper punched into a predetermined shape and comprises a slender horizontal portion 41, an apparatus attaching portion 42 extended substantially orthogonally from an upper edge of one end portion of the horizontal portion 41, and a bonding portion 43 extended upward in a state of being offset from an upper edge of other end portion of the horizontal portion 41. The bonding portion 43 constitutes a flat plate shape having a width the same as that of the bonding portion 33 of the terminal metal piece 30.

Figure 3:
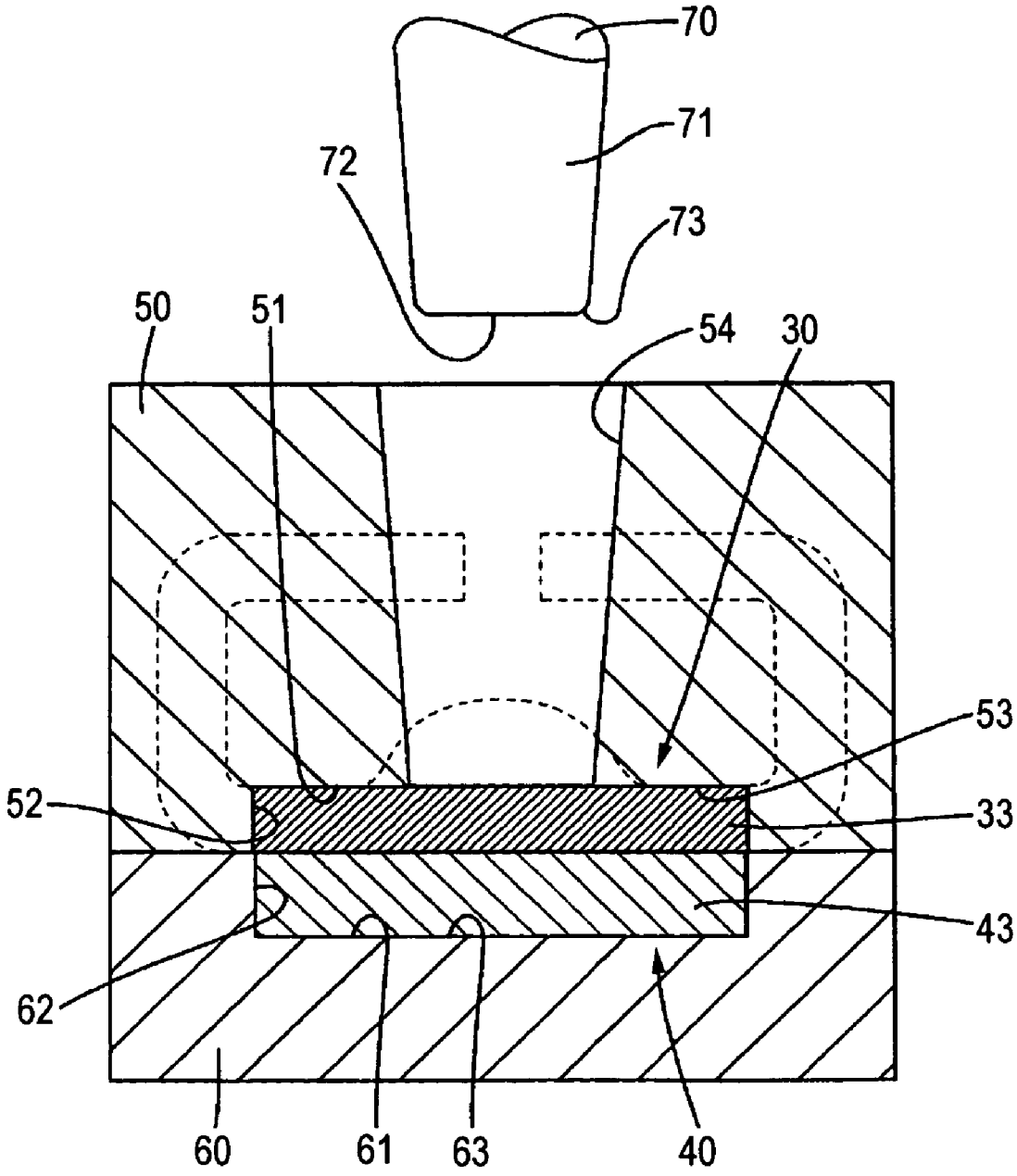
FIG. 3 is a sectional view showing a step of bonding the terminal metal piece and the bus bar.
Figure 4:
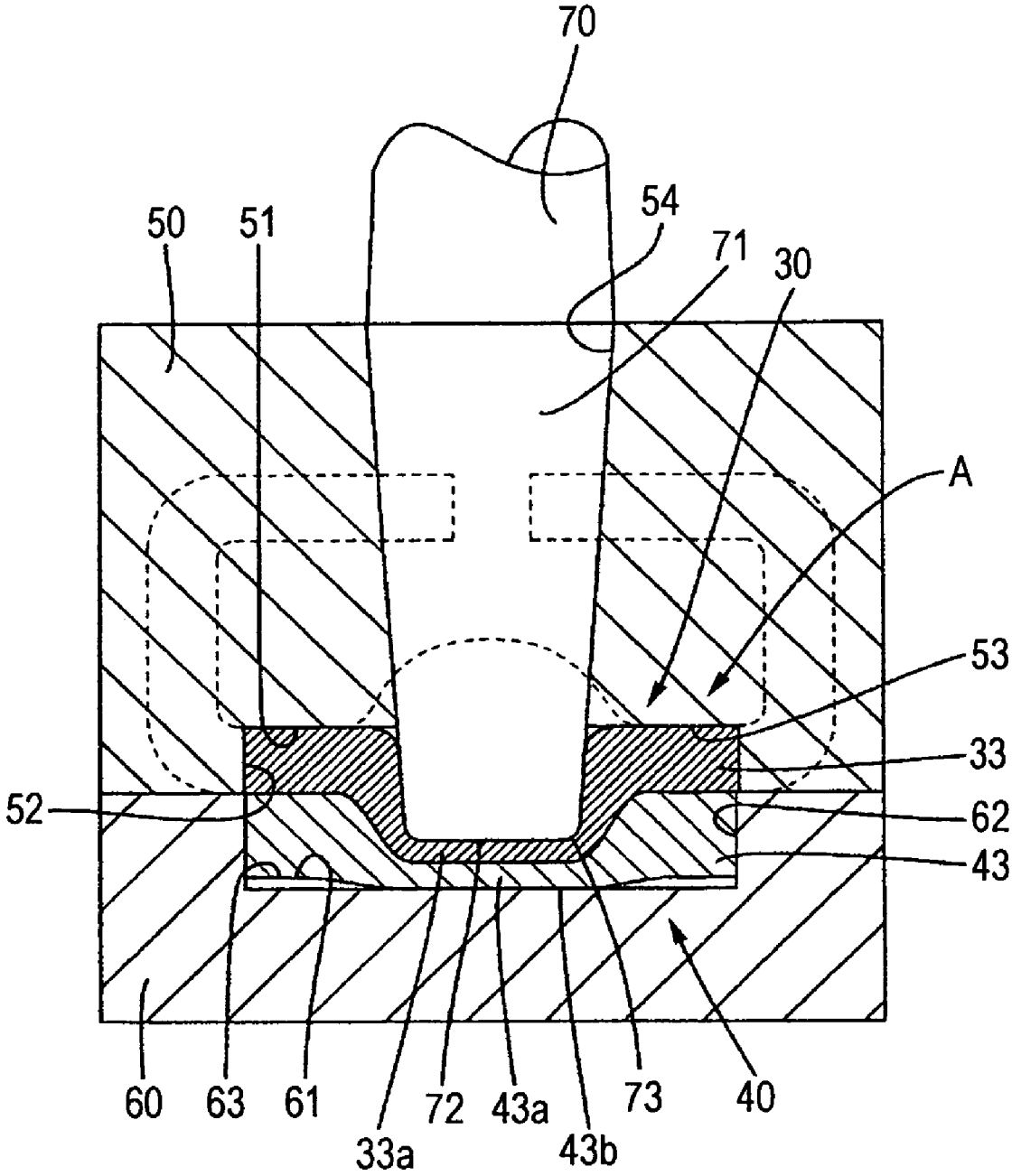
FIG. 4 is a sectional view showing a state of finishing to bond the terminal metal piece and the bus bar.
Figure 5:
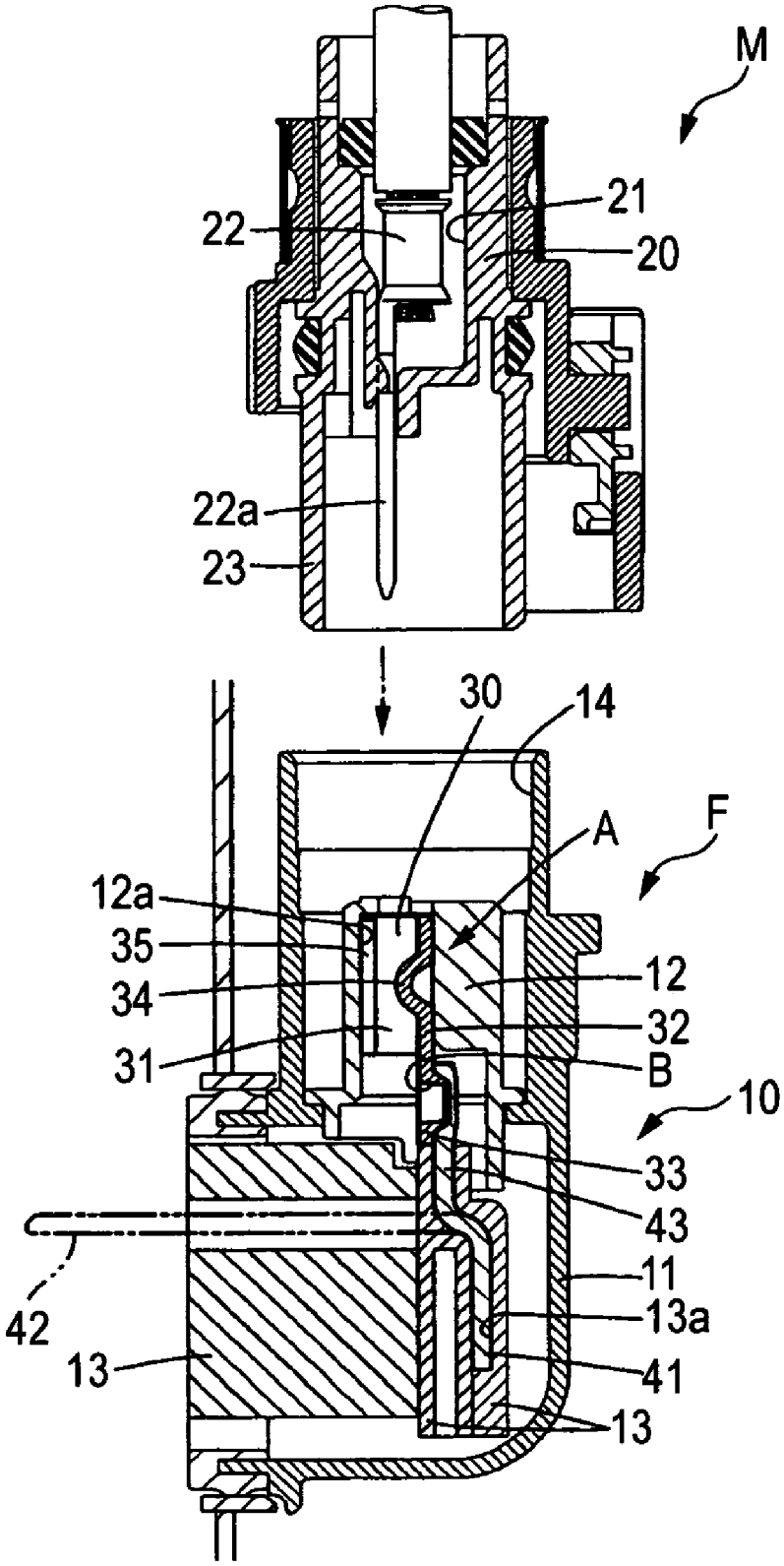
FIG. 5 is a sectional view showing a state of separating connectors.
Figure 6:
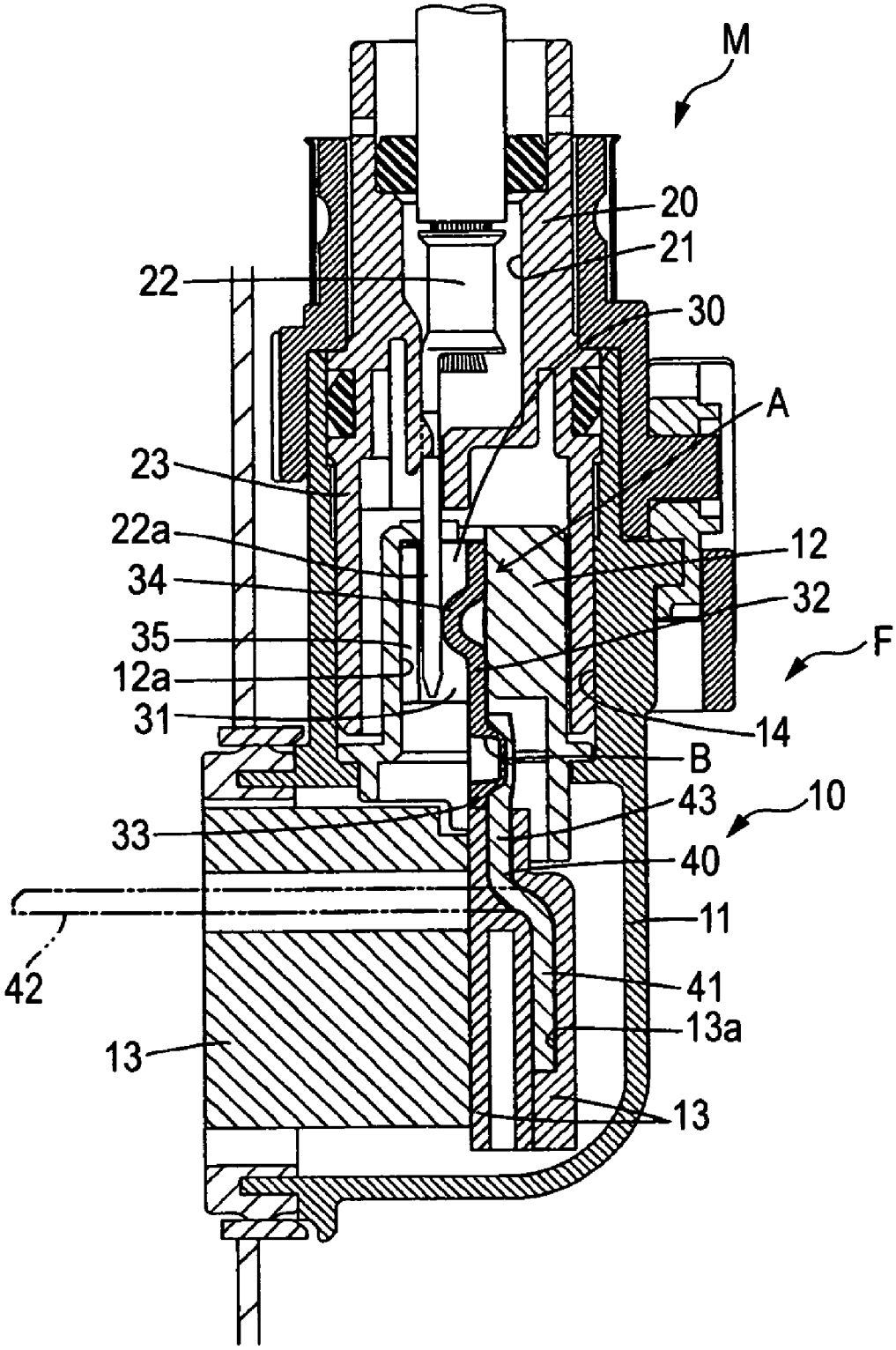
FIG. 6 is a sectional view showing a state of fitting the connectors.

A hardness of the terminal metal piece 30 is HV85 and a hardness of the bus bar 40 is HV85. That is, the hardness of the terminal metal piece 30 is higher than that of the bus bar 40 and the terminal metal piece 30 is more difficult to be deformed. As shown by FIG. 3 and FIG. 4, the terminal metal piece 30 and the bus bar 40 are bonded to each other to be able to be electrically conductive in a state of overlapping bonding portions 33, 43 thereof in an up and down direction (in a state of being laid down orthogonally from an attitude of being integrated to the housing). Here, the bonding portion 33 of the terminal metal piece 30 having the high hardness is overlapped on a side of an upper face (surface) of the bonding portion 43 of the bus bar 40, which is an arrangement in consideration of pressing the bonding portions 33, 43 by a die 70 having a bonding member in a lower direction from above.

Next, a cold pressure welding apparatus will be explained.

An upper jig 50 is made of an alloy tool steel (SKD11), having a thick plate shape as a whole, and is formed with a cavity 51 for containing the terminal metal piece 30 at a lower face thereof. Inside of the cavity 51 is contained with the bonding portion 33 of the terminal metal piece 30 by being positioned without play (displacement) in a horizontal direction (direction substantially orthogonal to a direction of pressing the die 70). An inner side face of the cavity 51 functions as a restricting portion 52 for restricting the terminal metal piece 30 from being deformed to enlarge a projected shape viewed in the die pressing direction, that is, a shape of an upper face (surface) of the bonding portion 33. Further, a ceiling face of the cavity 51 functions as a restricting portion 53 for restricting the terminal metal piece 30 and the bus bar 40 from being warped back to a side opposed to the direction of pressing the die 70 at a surrounding of a recess portion B.

Further, the upper jig 50 is formed with a guide hole 54 having a circular shape in an up and down direction (direction orthogonal to plate faces of the bonding portions 33, 43) reaching a ceiling face (inner face) of the cavity 51 from an upper face thereof. An inner peripheral face of the guide hole 54 constitutes a taper shape a diameter of which is gradually contracted in a lower direction (direction the same as a direction of pressing the die 70 to the terminal metal piece 30 and the bus bar 40). Further, the upper jig 50 is fixed to a lower jig 60 by bolts (not illustrated) axis lines of which are directed in an up and down direction at peripheral portions (four corners) thereof, and when a pressure in the two jigs 50, 60 is increased as mentioned later, the upper jig 50 is made to be able to be elastically deformed to bend in an upper direction by substantially having a center by the guide hole 54 remote from the bolt fastening portions. Further, the ceiling face of the cavity 51 of the upper jig 50 is subjected to mirror finish as means for reducing a friction resistance between the ceiling face and the upper face of the bonding portion 33 of the terminal metal piece 30.

The lower jig 60 is made of an alloy tool steel (SKD11) similar to the upper jig 50 and constitutes a thick-walled plate shape as a whole. An upper face of the lower jig 60 is formed with a cavity 61 for containing the bonding portion 43 of the bus bar 40. In a state of containing the bonding portion 43 in the cavity 61, the bonding portion 43 is positioned without play (displacement) in the horizontal direction. An inner side face of the cavity 61 functions as a restricting portion 62 for restricting the bus bar 40 from being deformed to enlarge a projected shape viewed in the die pressing direction, that is, a projected shape viewed from sides of the upper faces (surfaces) of the bonding portions 33, 43. Further, a bottom face of the cavity 61 functions as a restricting portion 63 for restricting the terminal metal piece 30 and the bus bar 40 from being deformed to warp back to a side of being opposed to the direction of pressing the die 70 at a surrounding of the recess portion B. Further, an inner face of the cavity 61 of the lower jig 60 is subjected to mirror finish as a member for reducing a friction resistance between the inner face and the lower face of the bonding portion 43 of the bus bar 40.

The die 70 is made of an alloy tool steel (SKD11) and a hardness thereof is HV700 through 750. The die 70 constitutes a circular cylinder shape an axis line of which is directed in an up and down direction, and an outer peripheral face 71 thereof constitutes a taper shape a diameter of which is contracted in the direction of pressing the terminal metal piece 30. The die 70 is inserted into the guide hole 54 from above the upper jig 50 and in a state of bonding the terminal metal piece 30 and the bus bar 40 correctly (state of finishing pressure welding), a portion of the die 70 having the taper shape is fitted to the guide hole 54 without play in a front and rear direction and in a left and right direction.

A lower face of the die 70 constitutes a pressing face 72 having a circular shape concentric with the die 70. The pressing face 72 is a flat face orthogonal to the direction of pressing the bonding portions 33, 43 by the die 70. The pressing face 72 and the outer peripheral face 71 of the die 70 in the taper shape are continuous to each other via an arc-like face 73. Further, a surface of the die 70 brought into contact with the terminal metal piece 30 (the outer peripheral piece 71, the pressing face 72 and the arc-like face) is subjected to mirror finish as means for reducing a friction resistance between the surface and the upper face of the bonding portion 33 of the terminal metal piece.

Next, a step of bonding the terminal metal piece 30 and the bus bar 40 will be explained.

In fabricating the conductive path A by bonding the terminal metal piece 30 and the bus bar 40, bonding regions 33*a*, 43*a* (regions in correspondence with the die 70) of the bonding portions 33, 43 are polished by using a scraper (scraping), wire brush, buff or the like. By the polishing, oxide films on the surfaces of the bonding portions 33, 43 are removed, bonding strength is increased, close adherence is promoted and electric resistance is reduced.

After polishing the surfaces, the bonding portion 43 of the bus bar 40 is set to the cavity 61 of the lower jig 60, the bonding portion 33 of the terminal metal piece 30 is overlapped on the upper face of the bonding portion 43, the upper jig 50 is covered from thereabove, the two upper and lower jigs 50, 60 are integrated, and the lower face of the upper jig 50 and the upper face of the lower jig 60 are brought into contact with each other in a face contact state. Under the state, the two bonding portions 33, 43 are overlapped by each other in the face contact state in the up and down direction, held without play in the up and down direction by being pinched by the two upper and lower jigs 50, 60 and restricted from being deformed to be warped in the up and down direction.

When the die 70 is made to advance (move down) into the guide hole 54 from the state, at an initial stage of advancement, the pressing face 72 at the lower end of the die 70 presses the upper face (surface) of the bonding portion 33 of the terminal metal piece 30 from above, the upper face of the bonding portion 33 of the terminal metal piece 30 is deformed to be recessed by the pressing operation, and also the bonding portion 43 of the bus bar 40 pressed by a deformed portion of the bonding portion 33 is deformed to follow the deformed portion. At this occasion, an amount of deforming the bonding portion 43 of the bus bar 40 having the low hardness is larger than an amount of deforming the bonding portion 33 of the terminal metal piece 30.

Further, when the die 70 is moved down to a position of finishing to bond, the circular recess portion B is formed on the upper face of the bonding portion 33 of the terminal metal piece 30. When the two bonding portions 33, 43 are deformed by the die 70 in this way, the lower face of the bonding portion 33 of the terminal metal piece 30 and the upper face of the bonding portion 43 of the bus bar 40 are solidly bonded (pressure-welded) to each other at the bonding regions 33*a*, 43*a* substantially in the circular shape in correspondence with the pressing face 72 of the die 70 to thereby integrate the terminal metal piece 30 and the bus bar 40 to fabricate the conductive path A.

Further, in a procedure of moving the die 70 into the bonding portion 33 of the terminal metal piece 30 as described above, volumes of the bonding portions 33, 43 including an amount of moving the die 70 thereinto (amount of invading the cavities 51, 61) is increased and therefore, the upper jig 50 is elastically deformed to bulge in the upper direction by increasing the pressures at insides of the bonding portions 33, 43. Simultaneously therewith, the bonding portions 33, 43 pressed by the die 70 are deformed to extend while displacing to flow radially from the center of the pressing face 72 to the outer peripheral side, however, spread of the bonding portions 33, 43 in the front and rear direction and in the left and right direction is restricted by the restricting portions 52, 62 of the upper jig 50 and the lower jig 60 at this occasion and therefore, the deformed portion flowing radially from the center of the pressing face 72 is displaced in the upper direction along the outer periphery of the die 70. By the displacement in the upper direction, portions of the bonding portions 33, 43 excluding the bonding regions 33*a*, 43*a* in correspondence with the pressing face 72 of the die 70 are displaced in the upper direction to follow the upper jig 50. Further, there is produced a slight clearance (not illustrated) between the portions deformed in the upper direction and the lower face of the cavity 61 of the lower jig 60. From the above-described, the lower face of the bonding portion 43 of the bus bar 40 is produced with a deformed portion 43*b* to bulge in the lower direction (the direction the same as the direction of pressing the die 70) at substantially the circular region in correspondence with the pressing face 72 of the die 70.

The conductive path A fabricated as described above is integrated to the housing 10 in a state of maintaining the terminal metal piece 30 in the cavity 12*a* of the terminal holding portion 12, containing the bus bar 40 in the cavity 13*a* configured by the bus bar holding members 13 and projecting the apparatus attaching portion 42 in a side direction of the housing 10.

As described above, the embodiment is characterized in having the conductive path A by bonding the terminal metal piece 30 and the bus bar 40 which are overlapped while deforming the terminal metal piece 30 and the bus bar 40 to form the recess portion B on the surface side by pressing the terminal metal piece 30 and the bus bar by the die 70 in the direction of intersecting with the plate faces. When the terminal metal piece 30 and the bus bar 40 which are overlapped in this way are deformed to form the recess portion B by pressing by the die 70, at the bonding regions 33*a*, 43*a* which are pressed, the surface of the terminal metal piece 30 and the surface of the bus bar 40 are metallurgically bonded while being deformed. Therefore, in comparison with contact configured by simply bringing the surfaces of the terminal metal piece 30 and the bus bar 40 into contact with each other as in the case of coupling the surfaces by a rivet, the bonded conductive path A of the embodiment is excellent in bonding reliability.

Further, by using the jigs 50, 60 having the restricting portions 52, 62 for restricting the terminal metal piece 30 and the bus bar 40 from being deformed to enlarge the projected shape viewed in the die pressing direction (shapes of the upper faces of the bonding portions 33, 43) and the restricting portions 53, 63 for restricting the terminal metal piece 30 and the bus bar 40 from being deformed to warp back to the side of being opposed to the direction of pressing the die 70 at the surrounding of the recess portion B and pressing the terminal metal piece 30 and the bus bar 40 set to the jigs 50, 60 by the die 70, the both members 30, 40 are bonded by increasing the inner pressures of the terminal metal piece 30 and the bus bar 40. The terminal metal piece 30 and the bus bar 40 are constrained by the jigs 50, 60 provided with the restricting portions 52, 53, 62, 63, and therefore, the terminal metal piece 30 and the bus bar 40 can be contained in the cavities 12*a*, 13*a* in the housing 10 without play without producing a variation in a shape or a size of the conductive path A which has been subjected to pressure welding.

Further, when the terminal metal piece 30 and the bus bar 40 are pressed by the die 70 to deform to recess, regions of the terminal metal piece 30 and the bus bar 40 pressed by the die 70 are spread to deform while being displaced from centers to outer peripheral sides. Here, when the die 70 directly presses the bus bar 40 having the low hardness, much portion of a spreading amount accompanied by invasion of the die 70 is assigned to the bus bar 40 which is easy to deform, excessive slip is produced at a contact interface of the terminal metal piece 30 and the bus bar 40, as a result, there is a concern of producing a variation in a bonding strength.

In contrast thereto, according to the embodiment, the terminal metal piece 30 having the high hardness is pressed by the die 70 and therefore, when the terminal metal piece 30 having the high hardness is deformed to recess, in accordance therewith, also the bus bar 40 having the small hardness is followingly deformed to recess. Therefore, an amount of spreading the terminal metal piece 30 and an amount of spreading the bus bar 40 becomes substantially the same amount, excessive slip is not produced at the contact face of the terminal metal piece 30 and the bus bar 40 and therefore, the bonding strength of the terminal metal piece 30 and the bus bar 40 is not reduced.

Further, although the die 70 is moved into the upper face (surface) of the bonding portion 33 of the terminal metal piece 30, the outer peripheral face 71 of the die 70 is configured by the taper shape the diameter of which is contacted in the direction of pressing the bonding portion 33 and therefore, the die 70 is smoothly moved into the bonding portion 33.

Further, although the region of the bonding portion 33 of the terminal metal piece 30 pressed by the pressing face 72 of the die 70 is deformed to flow from a center to an outer peripheral side of the pressing face 72 and flow along the outer peripheral face 71 of the die 70, according to the embodiment, the pressing face 72 and the outer peripheral face 71 of the die 70 are smoothly made to be continuous via the arc-like face 73 and therefore, the bonding portions 33 is stably deformed to flow.

Further, although the region of the bonding portion 33 of the terminal metal piece 30 pressed by the pressing face 72 of the die 70 is deformed to flow along the surface of the die 70 (the pressing face 72 and the outer peripheral face 71 in the taper shape), according to the embodiment, the surface of the die 70 is subjected to mirror finish and therefore, the friction resistance between the die 70 and the bonding portion 33 is reduced and the bonding portion 33 is stably deformed to flow.

Further, although the region of the bonding portion 43 of the bus bar 40 pressed by the pressing face 72 of the die 70 is deformed to flow along the inner face of the cavity 61, according to the embodiment, the face of the lower jig 60 brought into contact with the bonding portion 43 is subjected to mirror finish and therefore, the friction resistance between the lower jig 60 and the bonding portion 43 is reduced and the bonding portion 43 is stably deformed to flow.

<Other Embodiments>

The invention is not limited to the embodiment explained by the description and the drawings but, for example, the following embodiments are also included in the technical range of the invention, further, the invention can be embodied by being variously changed within a range not deviated from the gist other than described below.

(1) Although according to the above-described embodiment, the recess portion formed on the surface of the conductive path is configured by a shape of a hole opened only to the surface of the terminal metal piece, the recess portion may be configured by a shape of a groove opened not only to the surface but also a side face of the terminal metal piece.

(2) Although according to the above-described embodiment, an explanation has been given of the case of single sheets of the terminal metal piece and the bus bar, a plurality of the terminal metal pieces can also be bonded to the single bus bar.

(3) Although according to the above-described embodiment, in the terminal metal piece and the bus bar having the different hardnesses, the terminal metal piece having the high hardness is arranged on the side of the surface pressed by the die, the bus bar having the low hardness may be arranged on the side of the surface pressed by the die.

(4) Although according to the above-described embodiment, a sectional shape of the die is configured by a circular shape, the sectional shape of the die maybe configured by a noncircular shape (for example, elliptical shape, oval shape, rectangular shape, polygonal shape or the like).

(5) Although according to the above-described embodiment, an explanation has been given of the case in which the hardnesses of the terminal metal piece and the bus bar differ from each other, the invention is applicable also to a case in which the hardnesses of the terminal metal piece and the bus bar are the same.

(6) Although according to the above-described embodiment, an explanation has been given of the case in which both of the terminal metal piece and the bus bar constitute the flat plate shape, the invention is applicable also to a case in which the terminal metal piece and the bus bar are bent by the same radius of curvature.

(7) Although according to the embodiment, an explanation has been given of the case in which the terminal metal piece is configured by the female shape, the invention is applicable also to a case in which the terminal metal piece is configured by a male shape.

(8) The conductive path of the invention is not limited to the connector contained in the housing but is applicable also to a conductive path having a junction box for distributing power to an electric equipment in an automobile, or a conductive path as a power circuit in a circuit constitution comprising a signal circuit and a power circuit.

What is claimed is:

1. A conductive path comprising:

a terminal metal piece; and a bus bar overlapped with the terminal metal piece, the overlapped terminal metal piece and bus bar constituting a joint portion that includes (i) a first main surface and (ii) a second main surface opposite the first main surface, wherein the terminal piece and the bus bar are bonded while the terminal piece and the bus bar are deformed to form a recess portion in the first main surface of the joint portion by pressing the terminal metal piece and the bus bar with a die in a first direction, which intersects a plane of contact between the terminal metal piece and the bus bar, in a state of setting the terminal metal piece and the bus bar to a jig, wherein the jig includes a first restricting portion that restricts a portion of the second main surface directly opposite the recess from deforming in the first direction beyond an original plane of the second main surface.

2. The conductive path according to claim 1, wherein the joint portion further includes a side surface connecting the first main surface and the second main surface, and wherein the jig further includes a second restricting portion that restricts the terminal metal piece and the bus bar from deforming beyond an original plane of the side surface.

3. The conductive path according to claim 1, wherein the jig further includes a third restricting portion that restricts the terminal metal piece and the bus bar from deforming in a second direction, opposite to the first direction, beyond an original plane of the first main surface.

4. A connector comprising:

a conductive path according to claim 1; and a housing capable of accommodating the conductive path.

5. The connector according to claim 4, wherein the joint portion further includes a side surface connecting the first main surface and the second main surface, and wherein the jig further includes a second restricting portion that restricts the terminal metal piece and the bus bar from deforming beyond an original plane of the side surface.

6. The connector according to claim 4, wherein the jig further includes a third restricting portion that restricts the terminal metal piece and the bus bar from deforming in a second direction, opposite the first direction, beyond an original plane of the first main surface.

7. A conductive path comprising:

a terminal metal piece having a first hardness;

a bus bar overlapped with the terminal metal piece, the bus bar having a second hardness substantially lower than the first hardness, the overlapped terminal metal piece and bus bar constituting a joint portion that includes (i) a first main surface, that is a surface of the terminal metal piece and (ii) a second main surface opposite the first main surface, wherein the terminal piece and the bus bar are bonded while the terminal piece and the bus bar are deformed to form a recess portion in the first main surface by pressing the terminal metal piece and the bus bar with a die in a direction that intersects a plane of contact between the terminal metal piece and the bus bar with the deformed region of the terminal piece pressed into the deformed bus bar region.

8. A connector comprising:

a conductive path according to claim 7; and a housing capable of accommodating the conductive path.

* * * * *